US008528228B2

(12) United States Patent
Ashrafzadeh et al.

(10) Patent No.: US 8,528,228 B2
(45) Date of Patent: Sep. 10, 2013

(54) LAUNDRY TREATING APPLIANCE WITH DRYING RACK DETECTION BASED ON IMAGING DATA

(75) Inventors: Farhad Ashrafzadeh, Stevensville, MI (US); James P. Carow, Saint Joseph, MI (US); Shreecharan Kanchanavally, Lisle, IL (US); Sathish Andrea Sundaram, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 957 days.

(21) Appl. No.: 12/388,722

(22) Filed: Feb. 19, 2009

(65) Prior Publication Data

US 2010/0205819 A1 Aug. 19, 2010

(51) Int. Cl.

| | |
|---|---|
| ***F26B 13/10*** | (2006.01) |
| ***F26B 3/00*** | (2006.01) |
| ***F26B 19/00*** | (2006.01) |
| ***G06K 9/00*** | (2006.01) |
| ***H04H 60/56*** | (2008.01) |
| ***G05B 15/00*** | (2006.01) |
| ***G03B 17/00*** | (2006.01) |

(52) U.S. Cl.

USPC ..... 34/529; 34/445; 34/88; 382/111; 382/107; 725/12; 700/259; 700/275; 116/213

(58) Field of Classification Search

USPC ..... 34/445, 524, 529, 449, 88, 560, 130; 8/137; 356/914; 73/1.56; 382/107, 111; 725/12; 700/259, 275; 116/213

See application file for complete search history.

(56) References Cited

U.S. PATENT DOCUMENTS

| | | | | |
|---|---|---|---|---|
| 3,316,659 | A * | 5/1967 | Lauck | 34/600 |
| 5,345,060 | A | 9/1994 | Hazan et al. | |
| 5,391,890 | A | 2/1995 | Migliorini | |
| 5,755,041 | A | 5/1998 | Horwitz | |
| 6,026,592 | A | 2/2000 | Herr | |
| 6,488,155 | B2 | 12/2002 | Lawandy et al. | |
| 7,200,511 | B2 * | 4/2007 | Damrath | 702/127 |
| 7,363,780 | B2 | 4/2008 | Lee et al. | |
| 7,415,781 | B2 * | 8/2008 | Barron et al. | 34/595 |
| 2001/0049846 | A1 | 12/2001 | Guzzi et al. | |
| 2002/0118366 | A1 | 8/2002 | Baldwin | |
| 2003/0034443 | A1 | 2/2003 | Kouznetsov et al. | |
| 2004/0249843 | A1 | 12/2004 | Damrath | |
| 2005/0004956 | A1 | 1/2005 | Pourdeyhimi | |
| 2005/0196046 | A1 | 9/2005 | Hudnut et al. | |
| 2006/0243931 | A1 | 11/2006 | Haran et al. | |
| 2006/0255300 | A1 | 11/2006 | Shakespeare | |
| 2007/0272272 | A1 | 11/2007 | Choi et al. | |
| 2008/0013818 | A1 | 1/2008 | Shakespeare | |
| 2008/0204733 | A1 * | 8/2008 | Jones et al. | 356/237.1 |
| 2008/0276964 | A1 | 11/2008 | Hendrickson et al. | |
| 2011/0067186 | A1 * | 3/2011 | Johansson | 8/137 |

FOREIGN PATENT DOCUMENTS

| | | | |
|---|---|---|---|
| DE | 3938822 | A1 | 5/1991 |
| DE | 19961459 | A1 | 7/2001 |
| DE | 10156157 | A1 | 5/2003 |

(Continued)

*Primary Examiner* — Kenneth Rinehart
*Assistant Examiner* — John McCormack
(74) *Attorney, Agent, or Firm* — Clifton G. Green; McGarry Bair PC

(57) ABSTRACT

The invention relates to a method of determining the presence of a drying rack based on image data of the laundry located in a treating chamber of a laundry treating appliance.

39 Claims, 10 Drawing Sheets

(56) References Cited

FOREIGN PATENT DOCUMENTS

| | | | | |
|---|---|---|---|---|
| DE | 10302866 | A1 | | 8/2004 |
| DE | 102005055411 | A1 | | 5/2007 |
| EP | 0544945 | A1 | | 6/1993 |
| FR | 2894996 | A1 | | 6/2007 |
| JP | 04012799 | A | * | 1/1992 |
| JP | 4244193 | A | | 9/1992 |
| JP | 04244193 | A | * | 9/1992 |
| JP | 10-277292 | A | | 10/1998 |
| JP | 2002224486 | A | | 8/2002 |
| JP | 2007-221711 | A | | 8/2007 |
| JP | 2008054960 | A | | 3/2008 |
| WO | 89/04887 | A1 | | 6/1989 |
| WO | 01/78573 | A2 | | 10/2001 |
| WO | 2008/000812 | A1 | | 1/2008 |

* cited by examiner

LAUNDRY TREATING APPLIANCE WITH DRYING RACK DETECTION BASED ON IMAGING DATA

BACKGROUND OF THE INVENTION

Laundry treating appliances, such as clothes washers, clothes dryers, refreshers, and non-aqueous systems, may have a configuration based on a rotating drum that defines a treating chamber in which laundry items are placed for treating. The laundry treating appliance may have a controller that implements a number of pre-programmed cycles of operation. The user typically manually selects the cycle of operation from the given pre-programmed cycles. Each pre-programmed cycle may have any number of adjustable parameters, which may be input by the user or may be set by the controller. The controller may set the parameter according to default values, predetermined values, or responsive to conditions within the treating chamber.

SUMMARY OF THE INVENTION

The invention relates to a method of determining the presence of a drying rack based on image data of the laundry located in a treating chamber of a laundry treating appliance.

DESCRIPTION OF AN EMBODIMENT OF THE INVENTION

Figure 1:
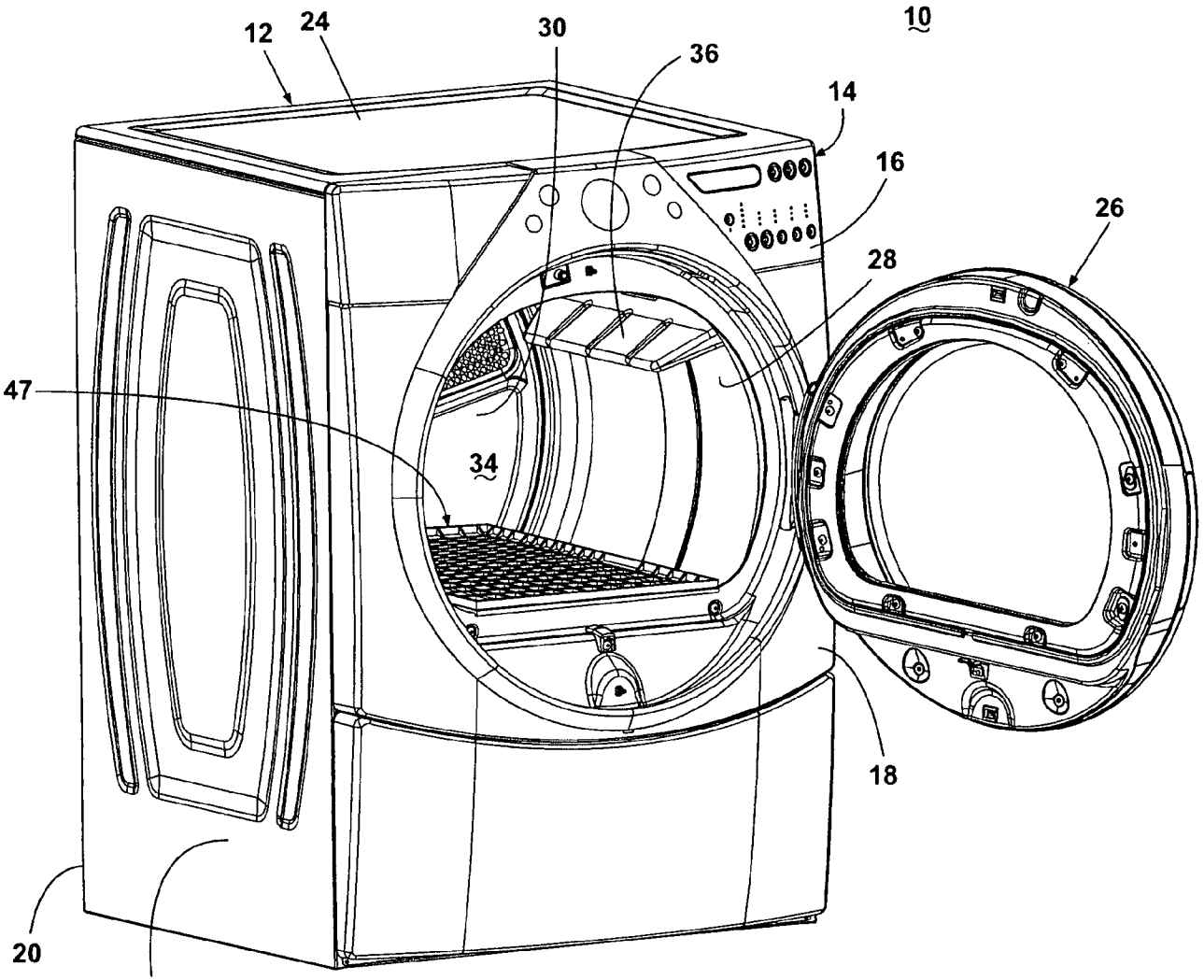
FIG. 1 is a front perspective view of a laundry treating appliance in the form of a clothes dryer with a treating chamber according to one embodiment of the invention.

FIG. 1 illustrates one embodiment of a laundry treating appliance in the form of a clothes dryer 10 according to the invention. While the laundry treating appliance is illustrated as a clothes dryer 10, the laundry treating appliance according to the invention may be any appliance which performs a cycle of operation on laundry, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet.

A rotatable drum 28 may be disposed within the interior of the cabinet 12 between opposing stationary rear and front bulkheads 30 and 32, which collectively define a treating chamber 34, for treating laundry, having an open face that may be selectively closed by the door 26. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

The drum 28 may include at least one lifter 36. In most dryers, there are multiple lifters. The lifters 36 may be located along the inner surface of the drum 28 defining an interior circumference of the drum 28. The lifters 36 facilitate movement of the laundry within the drum 28 as the drum 28 rotates.

Figure 2:
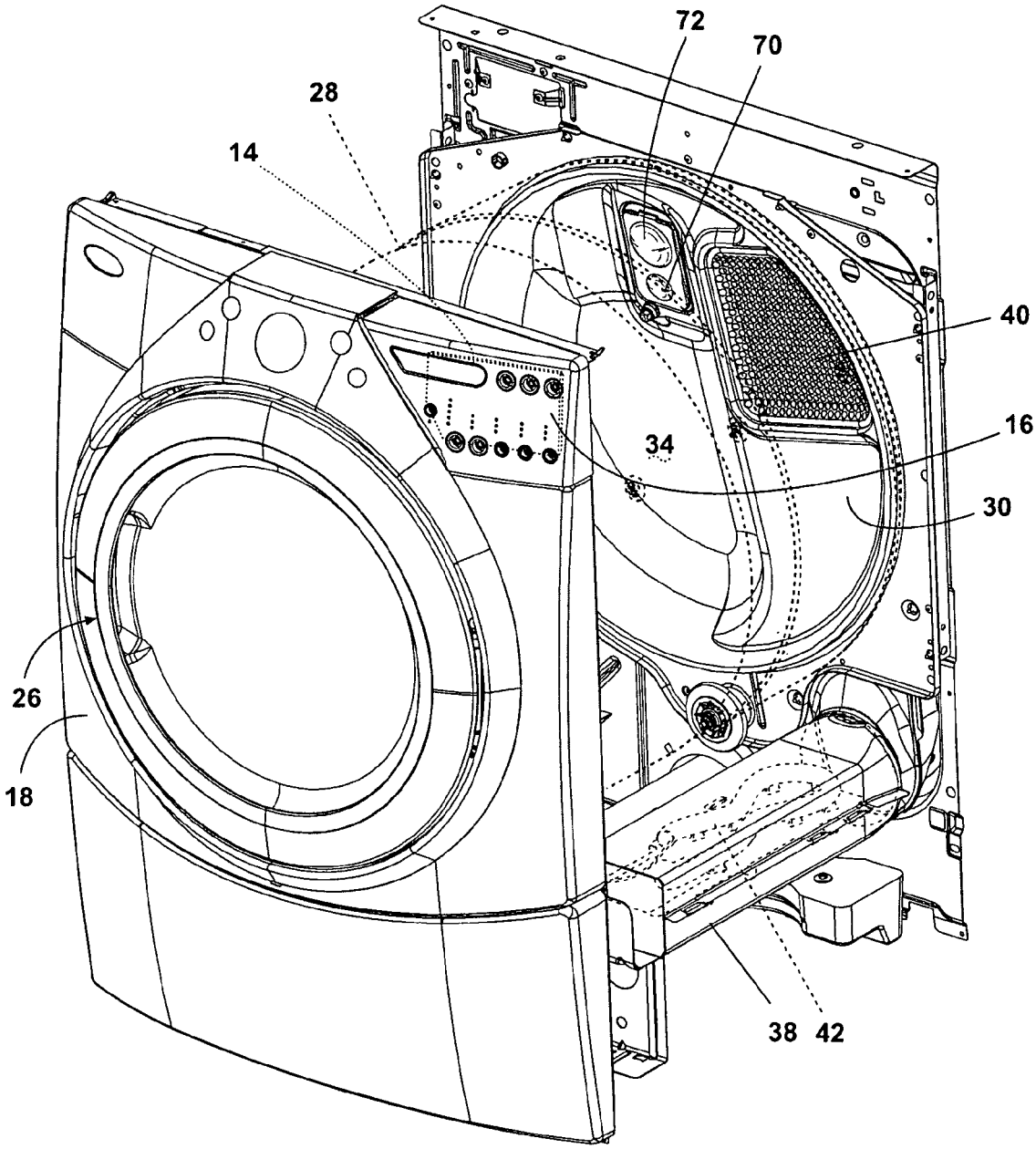
FIG. 2 is a partial perspective view of the dryer of FIG. 1 with portions of the cabinet removed for clarity according to one embodiment of the invention.

Still referring to FIG. 2, an air flow system for the clothes dryer 10 according to one embodiment of the invention will now be described. The air flow system supplies air to the treating chamber 34 and then exhausts air from the treating chamber 34. The supplied air may be heated or not. The air flow system may have an air supply portion that may be formed in part by an inlet conduit 38, which has one end open to the ambient air and another end fluidly coupled to an inlet grill 40, which may be in fluid communication with the treating chamber 34. A heating element 42 may lie within the inlet conduit 38 and may be operably coupled to and controlled by the controller 14. If the heating element 42 is turned on, the supplied air will be heated prior to entering the drum 28.

Figure 3:
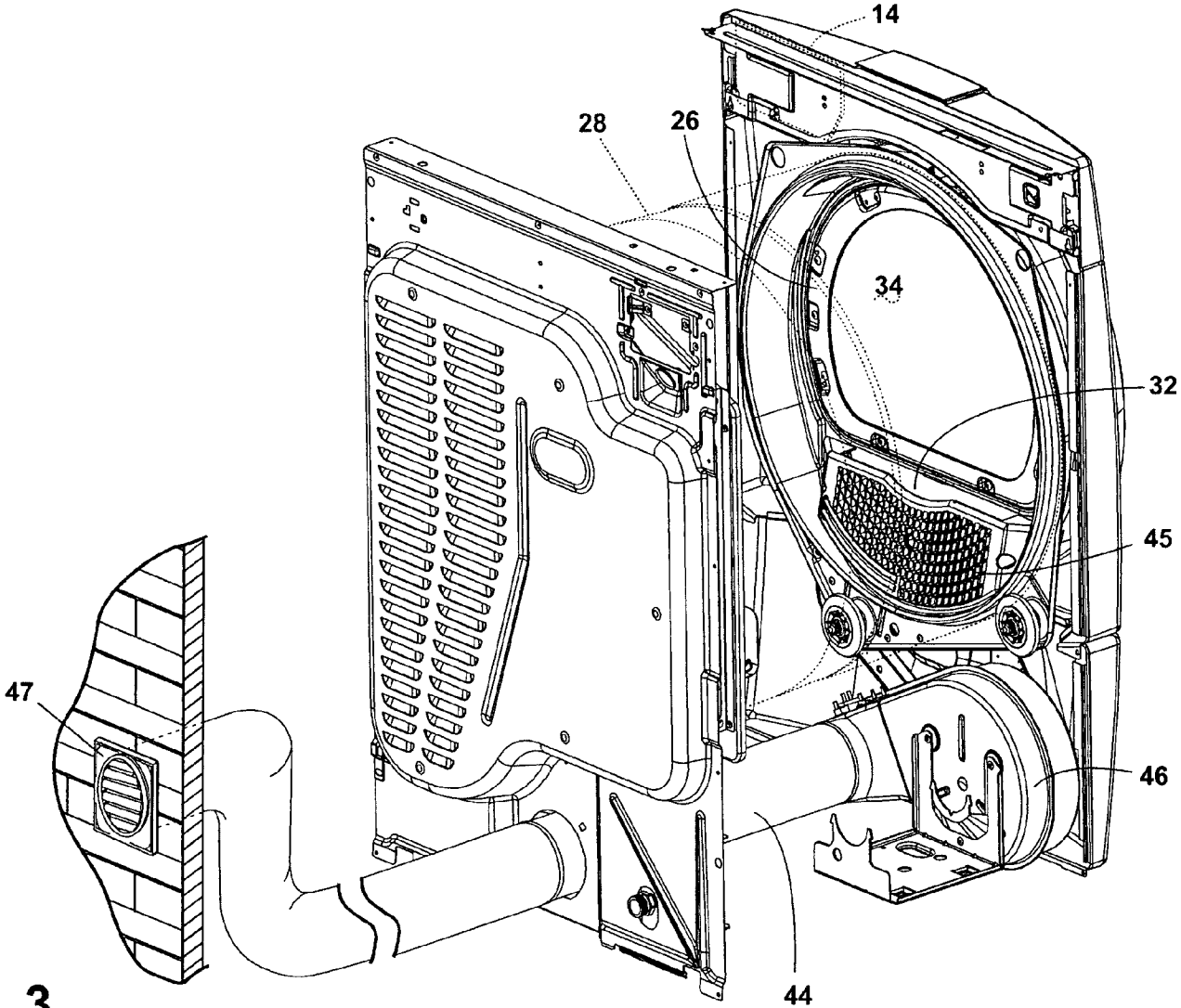
FIG. 3 is second partial perspective view of the dryer of FIG. 1 with portions of the cabinet removed for clarity according to one embodiment of the invention.

Referring to FIG. 3, the air supply system may further include an air exhaust portion that may be formed in part by an exhaust conduit 44 and lint trap 45, which are fluidly coupled by a blower 46. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct 47 for exhausting the air from the drying chamber to the outside.

Figure 4:
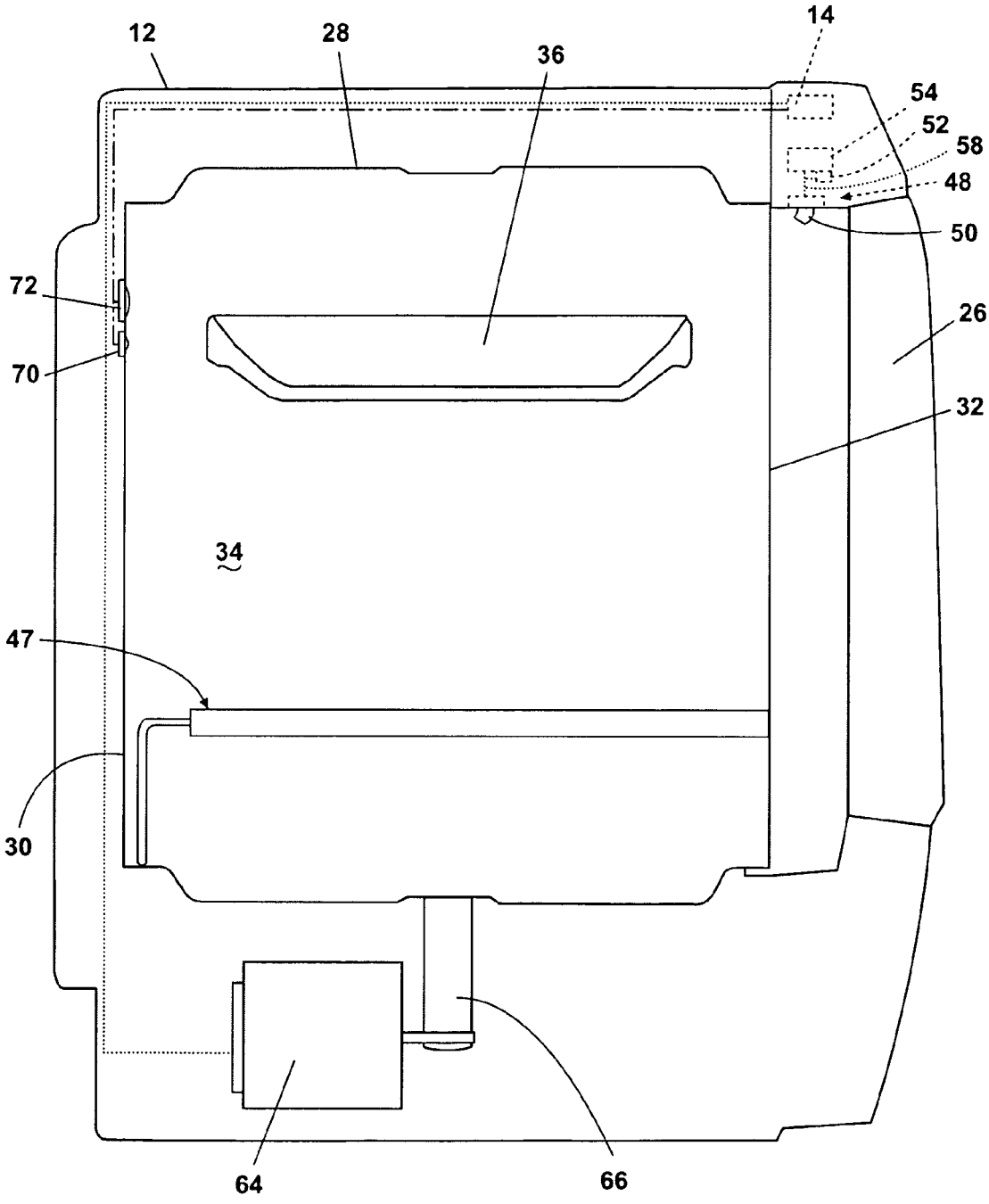
FIG. 4 is a cross-sectional, schematic side view of the dryer of FIG. 1 having an imaging system for imaging the treating chamber according to one embodiment of the invention.

As illustrated in FIG. 4, the clothes dryer 10 may be provided with a stationary drying rack 47 that may be selectively placed within the drum 28 by the user for supporting one or more articles to be dried in a generally horizontal position within the treating chamber 34. The drying rack 47 may be selectively placed within the drum 28 by the user to dry articles when tumbling action is not desired. For example, articles such as shoes, pillows, delicates clothing and stuffed animals may be placed on the drying rack 47 instead of placed directly in the drum to minimize damage or noise that may be caused by tumbling action or some other motion condition as a result of rotation of the drum 28 during a treating cycle.

The drying rack 47 may be supported within the treating chamber 34 by the rear and front bulkheads 30, 32 such that the drum 28 may rotate undisturbed by the presence of the drying rack 47. The invention is not limited to any particular drying rack and may be used with any apparatus that supports laundry articles placed within the dryer 10 above the surface of the drum 28.

Still referring to FIG. 4, the clothes dryer 10 may optionally have a dispensing system 48 for dispensing treating chemistries, including without limitation water or steam, into the treating chamber 34, and thus may be considered to be a dispensing dryer. The dispensing system 48 may include a reservoir 54 capable of holding treating chemistry and a dispenser 50 that fluidly couples with the reservoir 54 through a dispensing line 58. The treating chemistry may be delivered to the dispenser 50 from the reservoir 54 and the dispenser 50 may dispense the chemistry into the treating chamber 34. The dispenser 50 may be positioned to direct the treating chemistry at the inner surface of the drum 28 so that laundry may contact and absorb the chemistry, or to dispense the chemistry directly onto the laundry in the treating chamber 34. The type of dispenser 50 is not germane to the invention. A chemistry meter 52 may electronically couple, wired or wirelessly, to the controller 14 to control the amount of treating chemistry dispensed.

As is typical in a clothes dryer, the drum 28 may be rotated by a suitable drive mechanism, which is illustrated as a motor 64 and a coupled belt 66. The motor 64 may be operably coupled to the controller 14 to control the rotation of the drum 28 to complete a cycle of operation. Other drive mechanisms, such as direct drive, may also be used.

The clothes dryer 10 may also have an imaging device 70 to image the treating chamber 34 and/or anything within the treating chamber 34. Exemplary imaging devices 70 may include any optical sensor capable of capturing still or moving images, such as a camera. One suitable type of camera is a CMOS camera. Other exemplary imaging devices include a CCD camera, a digital camera, a video camera or any other type of device capable of capturing an image. That camera may capture either or both visible and non-visible radiation. For example, the camera may capture an image using visible light. In another example, the camera may capture an image using non-visible light, such as ultraviolet light. In yet another example, the camera may be a thermal imaging device capable of detecting radiation in the infrared region of the electromagnetic spectrum. The imaging device 70 may be located on either of the rear or front bulkhead 30, 32 or in the door 26. It may be readily understood that the location of the imaging device 70 may be in numerous other locations depending on the particular structure of the dryer and the desired position for obtaining an image. There may also be multiple imaging devices 70, which may image the same or different areas of the treating chamber 34.

The clothes dryer 10 may also have an illumination source 72. The type of illumination source 72 may vary. In one configuration, the illumination source 72 may be a typical incandescent dryer light which is commonly used to illuminate the treating chamber 34. Alternatively, one or more LED lights may be used in place of an incandescent bulb. The illumination source 72 may also be located behind the rear bulkhead 30 of the drum 28 such that the light shines through the holes of the air inlet grill 40. It is also within the scope of the invention for the clothes dryer 10 to have more than one illumination source 72. For example, an array of LED lights may be placed at multiple positions in either bulkhead 30, 32.

The illumination source 72 may be located on the same side of the drum 28 as the imaging device 70, as illustrated in FIG. 4, or located on a different side of the drum 28. When the illumination source 72 is located on the same side of the drum 28 as the imaging device 70, the imaging device 70 may detect the light that may be reflected by the drum 28 and the contents of the drum 28, such as the laundry load and the drying rack 47. Image analysis may then be used to separate the drum 28 from the contents of the drum 28. When the illumination source 72 is located on a side of the drum 28 opposite the imaging device 70, the imaging device 70 detects only the light from the illumination source 72 that is not blocked by the contents of the drum 28. At any instant in time, a given location in an image will be dark or light depending on whether or not an object is present at that location.

The illumination generated by the illumination source may vary, and may well be dependent on the type of imaging device. For example, illumination may be infrared if the imaging device is configured to image the infrared spectrum. Similarly, the illumination may be visible light, if the imaging device is configured to image the visible spectrum.

Figure 5:
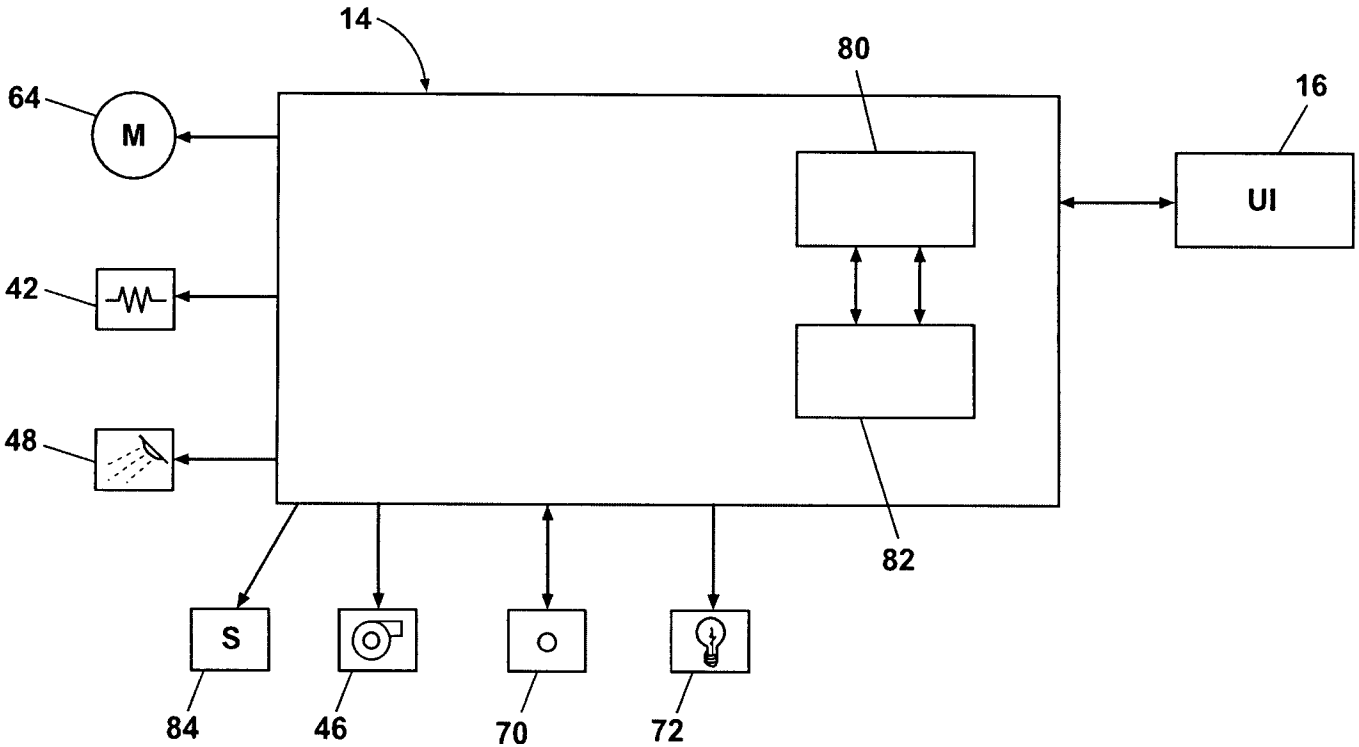
FIG. 5 is a schematic representation of a controller for controlling the operation of one or more components of the clothes dryer of FIG. 1 according to one embodiment of the invention.

As illustrated in FIG. 5, the controller 14 may be provided with a memory 80 and a central processing unit (CPU) 82. The memory 80 may be used for storing the control software that is executed by the CPU 82 in completing a cycle of operation using the clothes dryer 10 and any additional software. The memory 80 may also be used to store information, such as a database or table, and to store data received from one or more components of the clothes dryer 10 that may be communicably coupled with the controller 14.

The controller 14 may be communicably and/or operably coupled with one or more components of the clothes dryer 10 for communicating with and controlling the operation of the component to complete a cycle of operation. For example, the controller 14 may be coupled with the heating element 42 and the blower 46 for controlling the temperature and flow rate through the treating chamber 34; the motor 64 for controlling the direction and speed of rotation of the drum 28; and the dispensing system 48 for dispensing a treatment chemistry during a cycle of operation. The controller 14 may also be coupled with the user interface 16 for receiving user selected inputs and communicating information to the user.

The controller 14 may also receive input from one or more sensors 84, which are known in the art and not shown for simplicity. Non-limiting examples of sensors 84 that may by communicably coupled with the controller 14 include: a treating chamber temperature sensor, an inlet air temperature sensor, an exhaust air temperature sensor, a moisture sensor, an air flow rate sensor, a weight sensor, and a motor torque sensor.

The controller 14 may also be coupled with the imaging device 70 and illumination source 72 to capture one or more images of the treating chamber 34. The captured images may be sent to the controller 14 and analyzed using analysis software stored in the memory 80 to determine the presence of the drying rack 47. The controller 14 may then set one or more operating parameters to control the operation of the clothes dryer 10 based on the presence of the drying rack 47. The controller 14 may also analyze the images captured by the imaging device 70 to identify an article placed on the drying rack 47 and control the operation of the clothes dryer 10 based on the identity of the article.

The previously described clothes dryer 10 provides the structure necessary for the implementation of the method of the invention. Several embodiments of the method will now be described in terms of the operation of the clothes dryer 10. The embodiments of the method function to automatically determine the presence of the drying rack 47 within the treating chamber 34 and identify an article present on the drying rack 47.

The determined presence of the drying rack 47 and the identity of an article present on the drying rack 47 may be used to determine one or more operating parameters of the clothes dryer 10. Determining operating parameters of the clothes dryer 10 may include setting at least one of a drying temperature, an actuation of the heating element 42 for heating air supplied to the treating chamber 34, a rate of air supplied to the treating chamber 34, a rotation of the drum 28, a rotational speed and direction of rotation of the drum 28, a type of chemistry to dose and an amount of chemistry to dose.

Figure 6:
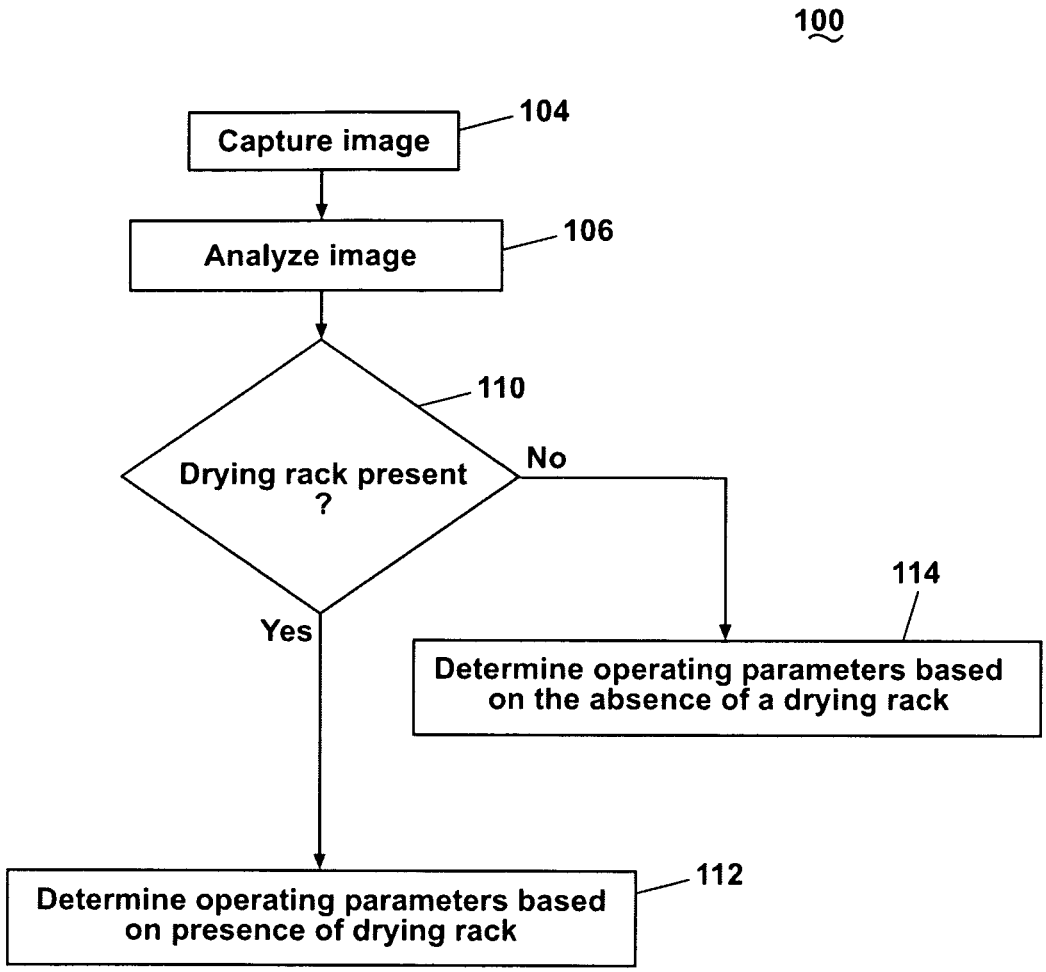
FIG. 6 is a flow chart illustrating a method for detecting the presence of a drying rack in the treating chamber according to a second embodiment of the invention.

Referring to FIG. 6, a flow chart of one method 100 of determining the presence of a drying rack 47 within the treating chamber 34 and determining one or more operating parameters based on the presence of the drying rack 47 is shown in accordance with the present invention. The method 100 may be executed automatically by the controller 14 prior to or after the initiation of a drying or treatment cycle of the clothes dryer 10 by the user. For example, the method 100 may be initiated upon the opening or closing of the door 26, the selection of an operating cycle by the user or the start of an operating cycle. Alternatively, the method 100 may be initiated manually by the user through the user interface 16.

The sequence of steps depicted is for illustrative purposes only, and is not meant to limit the drying rack detection method 100 in any way as it is understood that the steps may proceed in a different logical order or additional or intervening steps may be included without detracting from the invention.

The method 100 starts with assuming that user has opened the door 26 and has placed the drying rack 47 inside the drum 28 or is in the process of placing the drying rack 47 inside the drum 28. In step 104, the imaging device 70 may be used to capture an image of some portion of the treating chamber 34. Step 104 may be initiated automatically by the controller 14 or manually by the user.

The image captured in step 104 may be sent to the controller 14 for image analysis using software that is stored in the memory 80 of the controller 14. It is also within the scope of the invention for the imaging device 70 to have a memory and a microprocessor for storing information and software and executing the software, respectively. In this manner, the imaging device 70 may analyze the captured image data and communicate the results of the analysis with the controller 14.

In step 106, analyzing the image may include separating the image of the content of the drum 28 from the background, i.e. the dryer drum 28, in the image captured in step 104 to determine if the drum content image indicates the presence of the drying rack 47. Separating the drum content image from the background may include identifying the drum content image within the image or relative to the background. Alternatively, separating the image from the background may include extracting one or more portions of the drum content image from the captured image.

Once the drum content image is separated from the background, an image of the treating chamber 34 may be created wherein each pixel in the image indicates the presence or absence of an object, in this case, the drying rack 47. Any suitable method may be used to separate the drum content from the background in the image. There are several methods for separating the drum content image from the background depending on the illumination configuration, drum properties and the contents of the drum 28.

For example, in the case of an illumination configuration where the illumination source 72 is located on the same side of the drum 28 as the imaging device 70, techniques such as edge detection, color segmentation and deviation from a known background image may be used to separate the content of the drum 28 from the background. Edge detection may be calculated using known methods. Color segmentation involves separating the individual articles within the drum 28 from each other and separating the drum content from the background based on differences in the saturation, hue and luminance of objects in the image.

Both the drying rack 47 and dryer drum 28 may be enhanced to facilitate the separation of the drying rack 47 from the drum 28. For example, the drying rack 47 and/or dryer drum 28 may be made to have a predetermined luminance or color, which may be a solid or a pattern, that can easily be identified and not expected to be present in the load. The drying rack 47 and/or drum 28 may also be made of a material that is uniquely viewable under special lighting conditions, such as ultraviolet or infrared, and the illumination source may be configured to produce the special lighting conditions.

In the case of an illumination configuration in which the contents of the drum are back lit from an illumination source 72 located on a portion of the drum 28 opposite from the imaging device 70, separation of the drum content from the background is simplified. The areas in which objects are present within the drum 28 will appear black or dark in the image, since light from the illumination source 72 is blocked by the objects. In places where no objects are present, the light from the illumination source may be detected by the imaging device 70.

Regardless of how the drum content image is separated from the background in step 106, the images captured by the imaging device 70 may be used to determine if the drum content image indicates the presence of the drying rack 47. For example, the image may be used to calculate the area, perimeter, center of mass, radius and major or minor axis of the objects within the drum 28 using known methods and one or more of these parameters may be used to determine if the drum content image is indicative of the presence of the drying rack 47. The drum content image may also be compared to images stored in a database accessible by the controller 14 to determine if the drying rack 47 is present.

If it is determined in step 110 that a drying rack 47 is present, one or more operating parameters may be set according to the detected presence of the drying rack 47. Examples of operating parameters that may be set based on the presence of the drying rack 47 include setting at least one of a drying temperature, an actuation of the heating element 42 for heating air supplied to the treating chamber 34, a rate of air supplied to the treating chamber 34, a rotation of the drum 28, a rotational speed and direction of rotation of the drum 28, a type of chemistry to dose and an amount of chemistry to dose.

For example, if it is determined that a drying rack 47 is present, the controller 14 may determine that it is not necessary to rotate the drum 28 and may disengage the motor 64 so that the drum 28 does not rotate. In another example, the controller 14 may change the amount of a chemistry dispensed for a selected operating cycle based on the determination of the presence of the drying rack 47.

If it is determined that the drum content image analyzed in step 106 does not indicate the presence of a drying rack 47, the operating parameters may be determined in step 114 based on the absence of the drying rack 47.

Analyzing the image does not have to be based on separating the drying rack 47 from the treating chamber 34 to determine the presence of the drying rack 47. Another method may include analyzing the image for specific features that are indicative of the drying rack 47. The drying rack 47 may include specific physical structures, such as reflective surfaces, that are easily detected based on an analysis of the image. Similarly, the drying rack 47 may be made from a specific material that is easily detected. These structures and surfaces may be designed for easy detection under special light conditions (angle of light, intensity of light, stroboscopic, etc.) or type of light (visible, ultraviolet, infrared, etc.).

Figure 7:
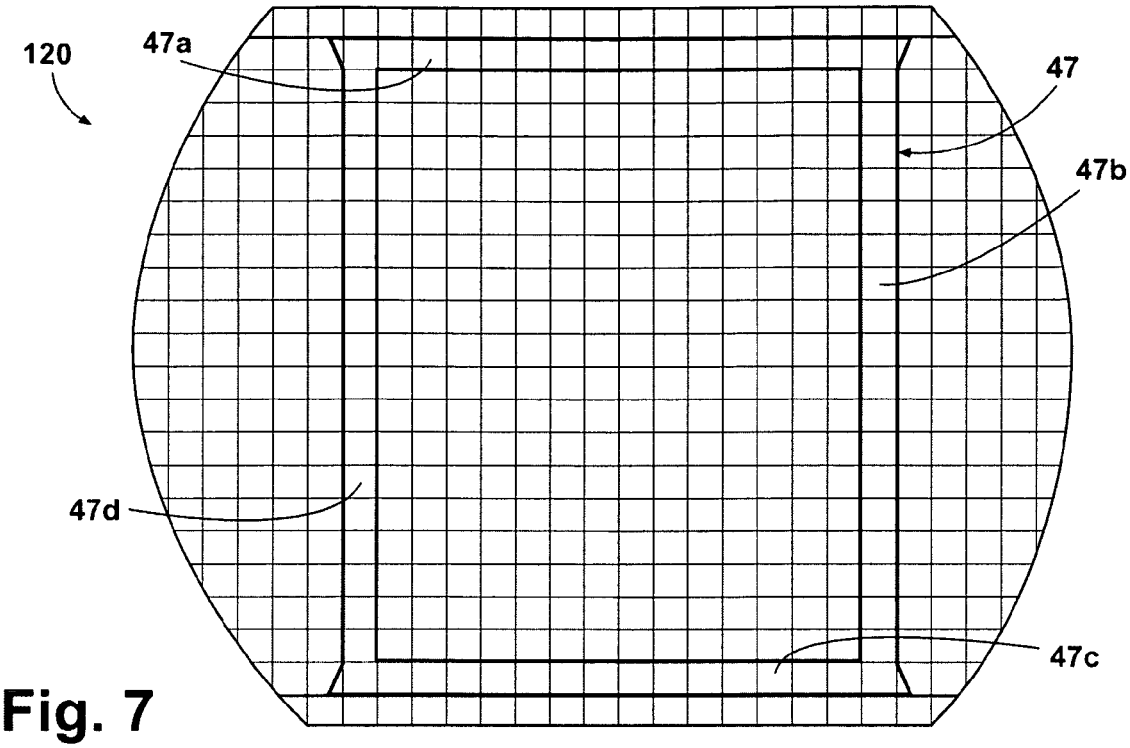
FIG. 7 is a schematic representation of an actual image of the drying rack for detecting the presence of a drying rack according to a third embodiment of the invention.

FIG. 7 is a schematic illustrating an example of an analysis of an image 120 that takes advantage of the fact that the drying rack 47 presents one or more edges 47*a-d* that may be detected relative to the treating chamber 34. The image 120 is a schematic representation of a two-dimensional grid that may be applied to the image 120. The grid may be a function of the image, such as the pixel arrangement in a digital image, a function of the imaging sensor, such as a CMOS or CCD sensor having an arrangement of pixels, or a grid applied in the image analysis process. Regardless of how the grid might be projected onto the image, the grid may be used to analyze the relative location within the treating chamber. Additionally, in the case of an imaging device having a known field of view relative to the treating chamber, the grid may be used to represent the physical location of the treating chamber.

The analysis method also takes advantage of the fact that the location of the edge within the treating chamber 34 is at least generally known. More particularly, the location of the edge within the field of view of the imaging device 70 is known, enabling the analysis of the image based on the grid applied to the image 120 to look for the edge at the expected location on the grid.

For purposes of this description, each grid element will be referred to as a pixel, with the understanding that each grid element may be one pixel, a combination of pixels, or structures other than pixels.

Figure 8:
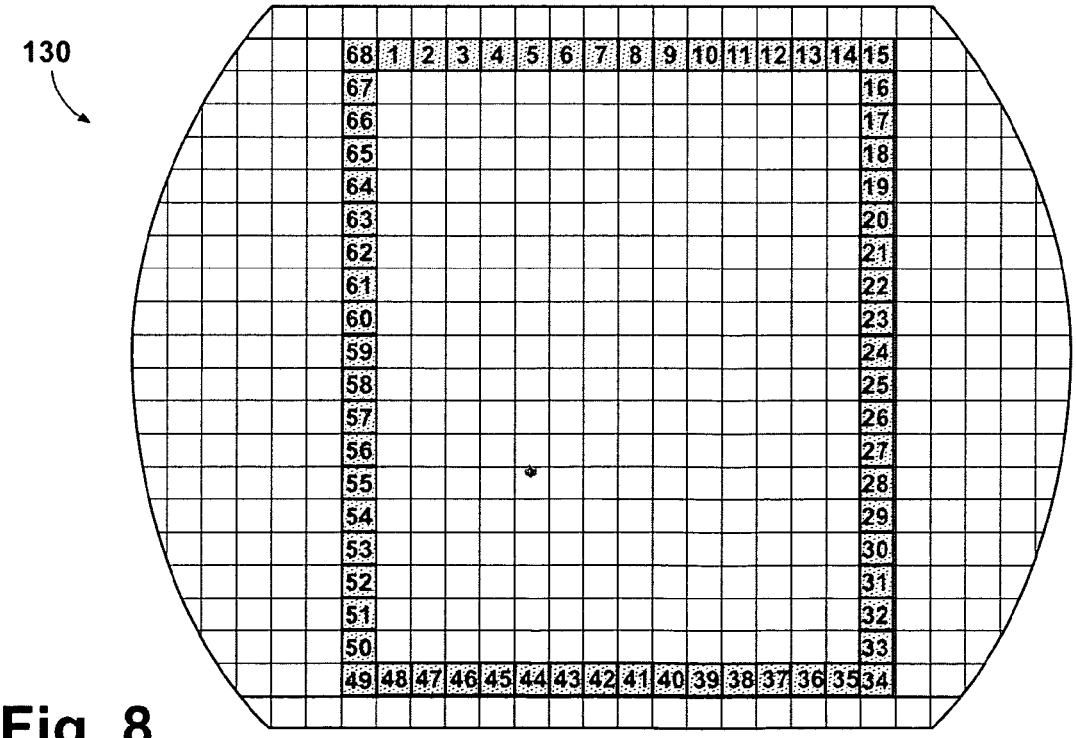
FIG. 8 is a schematic representation of a reference image for a drying rack in the treating chamber according to a third embodiment of the invention.

FIG. 8 is a schematic representation of a reference image 130 defining a reference shape for the drying rack 47. The reference shape identifies those pixels 1-68 where the edges 47*a-d* of the drying rack 47 would be if the drying rack 47 is positioned within the treating chamber 34.

Figure 9:
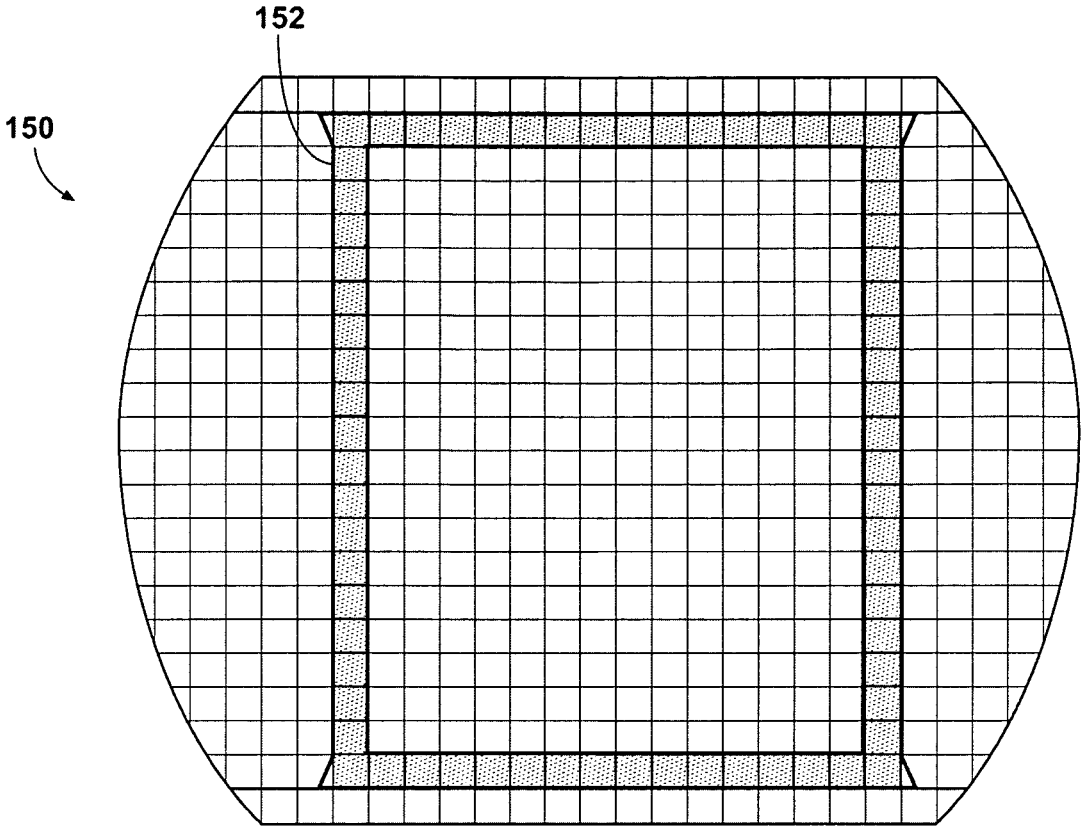
FIG. 9 is a schematic of an overlay of the schematic of FIGS. 7 and 8.

As seen in FIG. 9, the reference image 130 may be compared to the actual image 120, which is illustrated as an overlay image 150, to determine if there is a match. If there is a match, then it may be concluded that the drying rack is present. For purposes of making the match, it will not be necessary for there to be identity of the reference image 130 with the actual image 120. In some cases it will also not be necessary to match all of the reference image 130 with the actual image 120. For example, the edge 47*a* of the drying rack 47 is the rear edge. The presence of the rear edge alone and at the specific grid location may be sufficient to determine the presence of the drying rack 47 without having to compare the remainder of the reference image to the remainder of the actual image. The length of the rear edge 47*a* may be used in combination with the expected location to further refine the analysis. In such a case, the reference image may be only that of the rear edge 47*a*. The other edges may also be used as the sole reference image.

It should be noted that while illustrated and discussed as images, the actual images and reference images may be represented by algorithms, formulas, or inputs to a formula. For example, the reference shapes may be stored in the memory as fractals and the image may be converted to a fractal for comparison.

Figure 10:
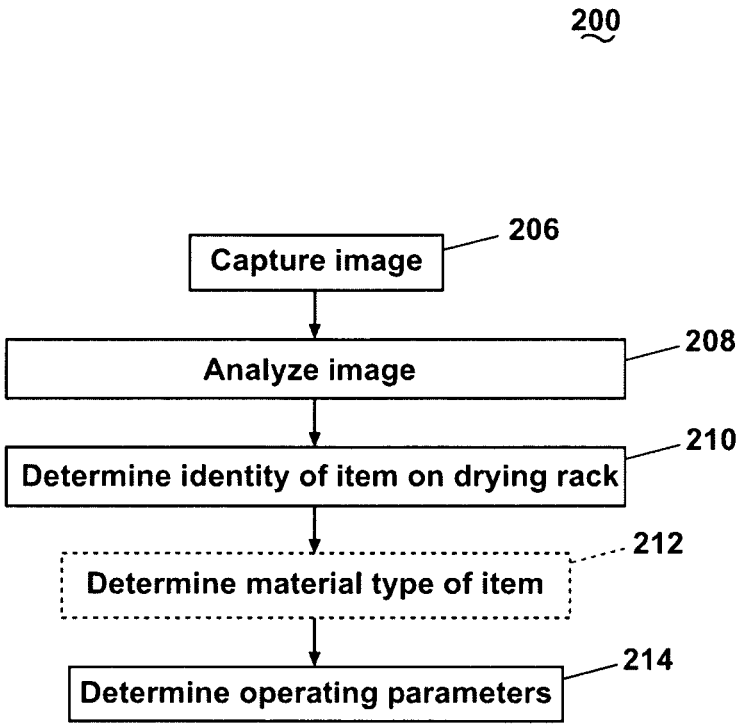
FIG. 10 is a flow chart illustrating a method for detecting the presence of an article on the drying rack according to a fourth embodiment of the invention.

FIG. 10 illustrates a method 200 for determining not only the presence of an article on the drying rack 47 using the imaging device 70, but also specific characteristics of the article, and determining one or more operating parameters based on the identity of the article. The method 200 assumes that the presence of the drying rack 47 has already been determined and that the user has placed one or more articles to be dried and/or treated on the drying rack 47. The presence of the drying rack 47 may be determined automatically, using method 100, for example, or some other method. Alternatively, the presence of the drying rack 47 may be determined manually, such as based on user input through the user interface 16, for example.

One or more images may be captured in step 206 of some portion of the treating chamber 34 and sent to the controller 14 for image analysis using software that is stored in the memory 80 of the controller 14. Alternatively, if the presence of the drying rack 47 is determined using method 100, the image captured in step 104 of the method 100 may be analyzed to determine the identity of the articles present on the drying rack 47.

In step 208, analyzing the image may include separating the laundry load from the background, i.e. the drying rack and/or dryer drum, in the image or images captured in step 206. It may also include analyzing the image for physical characteristics of the article for use in identifying the article. Examples of physical characteristics that may be used to identify the article include the edges, size and shape of the article. While it may be necessary to separate the load from both the drying rack 47 and the dryer drum 28, it is contemplated that for the case of a load placed on the drying rack 47, it will typically only be necessary to separate the load from the drying rack 47. Any suitable method may be used to separate the load from the background in the image. There are several methods for separating the load image from the background depending on the illumination configuration, drum properties and the load.

Separating the image of the article from the drying rack 47 may be done in the same way as described above with respect to separating the drying rack 47 from the drum 28. Separating the load image from the background may include identifying the load image within the image or relative to the background. Alternatively, separating the image from the background may include extracting one or more portions of the load image from the captured image.

For example, in the case of an illumination configuration where the illumination source 72 is located on the same side of the drum 28 as the imaging device 70, techniques such as edge detection, color segmentation and deviation from a known background image may be used to separate the load from the background. Edge detection may be calculated using known methods. Color segmentation involves separating the individual articles in a load from each other and separating the load from the background based on differences in the saturation, hue and luminance of objects in the image. The surface of the dryer drum 28 and/or the drying rack 47 may also contain optically detectable features to aid in the separation of the load from the background image of the drum 28 and drying rack 47.

In the case of an illumination configuration in which the load is back lit from an illumination source 72 located on a portion of the drum 28 opposite from the imaging device 70, separation of the load from the background is simplified. The areas in which a load is present will appear black or dark in the image, since light from the illumination source 72 is blocked by the load. In places where the load is not present, the light from the illumination source may be detected by the imaging device 70.

Once the load image is separated from the background, an image of the treating chamber 34 may be created wherein each pixel in the image indicates the presence or absence of the load. The image separation techniques may also be used to separate one load article from another article present on the drying rack 47.

Regardless of how the load image is separated from the background in step 208, the images captured by the imaging device 70 may be used to determine the identity of an article present on the drying rack 47 in step 210. For example, the image may be used to determine the size, shape, area, perimeter, center of mass, radius and major or minor axis of the load using known methods and one or more of these parameters may be used to determine the identity of the article or articles forming the load. The analyzed image may also be compared to images stored in a database accessible by the controller 14 to determine the identity of the article present on the drying rack 47.

For example, an article may be identified as corresponding to an article belonging to a predetermined set of categories such as clothing, footwear and stuffed articles, based on their perimeter as determined during image analysis in step 208. The determined perimeter may be analyzed by comparing the determined perimeter to the perimeter of known articles within each category stored in a table or database or analyzed using one or more functions. In another example, an article may be identified based on its size relative to the known size of the drying rack 47. Alternatively, the image may be compared to stored images of various articles belonging to each category using pattern recognition techniques to determine what the load article in the analyzed image most closely resembles.

In another example, the article may be identified as corresponding to one of a group of members belonging to a predetermined set of categories. The article may first be identified as corresponding to a particular category of articles and then further identified as corresponding to a particular member within that category. For example, an article categorized as clothing may further be identified as a shirt/sweater, socks or pants. Articles categorized as footwear may be further identified as shoes or boots. Articles identified as stuffed may further be categorized as a pillow or a toy.

While the identity determining step 210 is described in the context of only three categories, clothing, footwear and stuffed articles, any number of categories may exist for which an article on the drying rack 47 may be identified as corresponding to. In addition, each possible category may be organized into any number of groups or levels within each category.

In addition to identifying the type of article on the drying rack 47 based on the physical characteristics of the article in step 210, the type of material the article is made from may also be determined from the physical characteristics of the article. The type of article and the type of material the article is made from may both be used by the controller 14 to set one or more operating parameters to control the operation of the clothes dryer 10. In this manner, an operating cycle may be specifically tailored to the individual needs of the articles present on the drying rack 47.

An optional step 212 may be provided for identifying additional physical characteristics of the identified article such as the surface pattern, thread count and reflectivity. In step 212, the image or images captured in step 206 may be analyzed to determine physical characteristics of the article corresponding to the type of material the article present on the drying rack 47 is generally made of. For example, if it is determined in step 210 that the article is a shirt, one of the images captured in step 206 may be analyzed to determine the weave pattern. The weave pattern may then be used to determine if the shirt is wool, cotton or synthetic. The type of material may also be determined by analyzing the reflectivity of the article.

Identifying the type of material the identified article is made from may include determining the area in the image corresponding to the article and analyzing the image in that area. For example, as described above, the pixels of the image may be used as a grid applied to the treating chamber 34 and the image may be analyzed using edge detection methods to identify an article present on the drying rack 47. The image pixels located within the detected edges of the article may be analyzed in step 212 to identify the physical characteristics of the article. This may include analyzing one or more areas of a predetermined size within the detected edges of the article. The number and size of the areas to analyze may vary depending on the type of article.

In step 214, the type of article determined in step 210 and, optionally, the type of material the article is primarily made from, as determined in step 212, may be used to set one or more operating parameters for the clothes dryer 10. Examples of operating parameters that may be set according to the identification of the article or articles present on the drying rack 47 include at least one of a drying temperature, an actuation of the heating element 42 for heating air supplied to the treating chamber 34, a rate of air supplied to the treating chamber 34, a rotation of the drum 28, a rotational speed and direction of rotation of the drum 28, a type of treating chemistry to dispense, a time to dispense a treating chemistry and an amount of treating chemistry to dispense.

For example, if it is determined in step 210 that the article present on the drying rack 47 is a boot, the controller 14 may disengage the motor 64 so that the drum 28 does not rotate to avoid potential interference between the boot and the drum baffles 36. In another example, the temperature of the drying air supplied to the treating chamber 34 and the type of chemistry dispensed for a given article identified as a clothing article may vary depending on whether it is determined if the clothing article is made from wool, cotton or a synthetic fabric.

In addition to setting one or more parameters of a cycle of operation based on the identity of an article present on the drying rack 47, the controller 14 may also use information received from one or more sensors 84. For example, an inlet and an exhaust temperature sensor may be used in combination with the determined identify of the article present on the drying rack 47 to determine the appropriate time to terminate a drying cycle.

Figure 11:
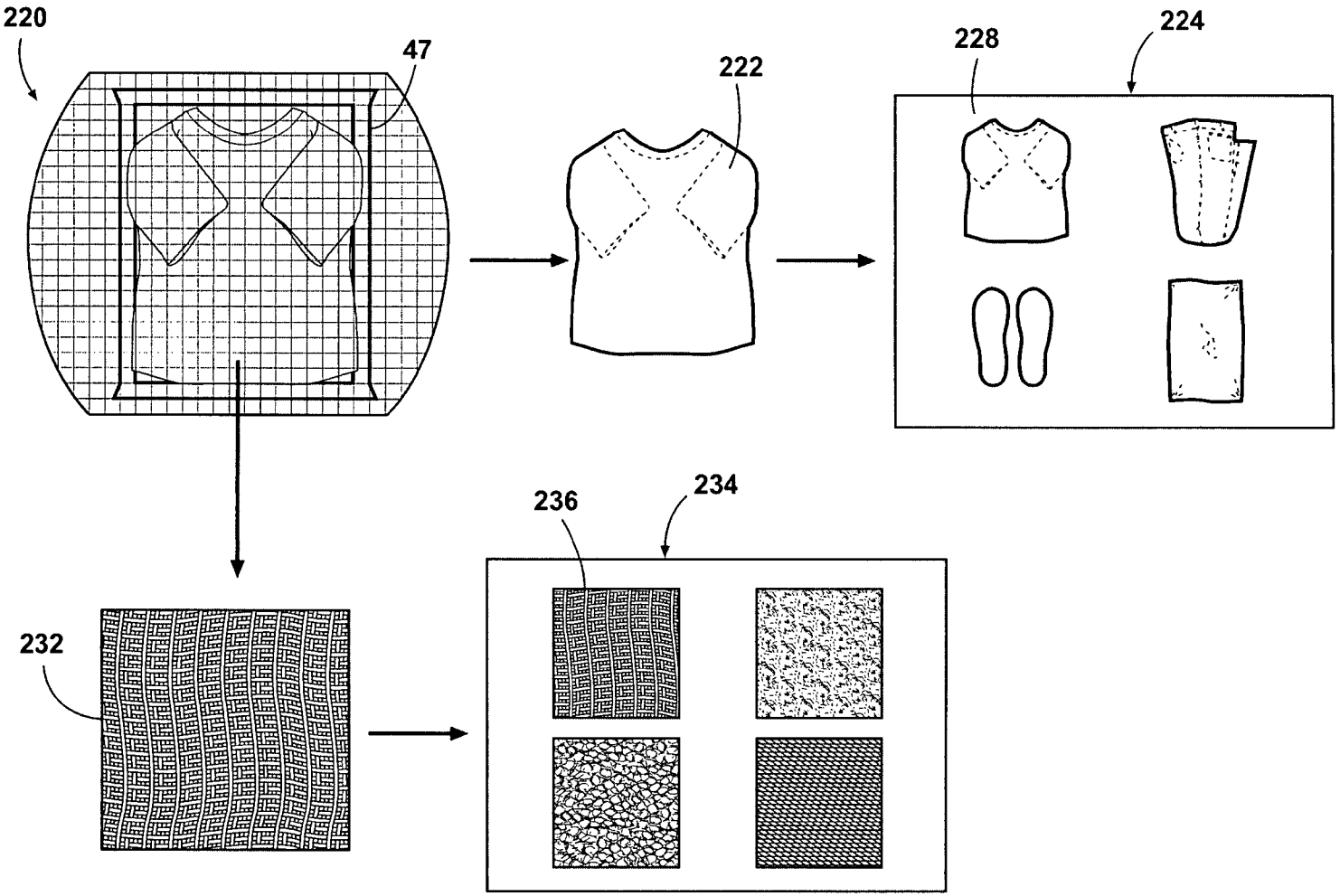
FIG. 11 is a schematic graphically illustrating the detecting of an article on the drying rack according to the fourth embodiment of the invention.

An example of the use of the method 200 for identifying an article present on the drying rack 47 is illustrated schematically in FIG. 11 and may include determining the presence of the drying rack 47, identifying an article present on the drying rack 47 and determining one or more physical characteristics of the article. The presence of the drying rack 47 may be determined as previously described according to steps 104 through 110 of the method 100 illustrated in FIG. 6.

As illustrated in FIG. 10, the method 200 may include separating an article 222 present on the drying rack 47 from the background, i.e. the drying rack 47. The article 222 may be separated from the background using edge detection methods, for example, to identify the article 222 within the image. Separation of the article 222 from the background does not necessarily include extracting the image of the article 222 from the rest of the image. The separated image of the article 222 may be compared to images in a database corresponding to various categories of articles such as shirts, pants, footwear, pillows, etc. . . . to determine which category the article 222 belongs to.

For example, the separated image of the article 222 may be compared to images in a database 224 using pattern recognition techniques to identify the category the image of the article 222 is consistent with. In this case, the article 222 may be identified as being consistent with an item or items in a category 228 which may include t-shirts, sweaters, dress shirts and blouses, for example.

The type of material may be determined in step 212 of method 200 by analyzing the physical characteristics of the article 222 and comparing the physical characteristics to known values in a database or a look-up table. Examples of physical characteristics that may be used to determine the type of material the article 222 is made from include color, reflectivity and thread count. Alternatively, an image of the surface of the article 222 may be compared using pattern recognition techniques to a database of different types of materials to determine the type of material the article 222 is made from. Either of these methods may be used for both woven materials, such as cotton or wool, and non-woven materials, such as leather or plastic.

As illustrated in FIG. 10, a high resolution image 232 of a portion of the image 220 corresponding to the area defined by the detected edges of the article 222 may be analyzed using pattern recognition techniques and compared to images in a database 234 to determine the category of material that the image 232 is consistent with. In this case, the image 232 may be identified as being consistent with a category 236 which may include cotton-type materials.

Once the type of article and type of material the article is made from is identified the controller 14 may determine one or more operating parameters in step 214 of the method according to the identity and physical characteristics of the article, in this case a shirt made from cotton. For example, the controller 14 may determine a type and amount of treating chemistry to dispense based on the identification of the article 222 as a shirt made from cotton. If the article 222 had been identified as a shirt made from a material other than cotton, for example wool, the controller 14 may determine a different type and/or amount of treating chemistry to dispense.

While the method 200 is described in the context of a identifying a single article present on the drying rack 47 and setting one or more operating parameters based on the identity of that single article, the method 200 may also be used to identify multiple articles present on the drying rack 47. Each article present on the drying rack 47 may be identified using method 200 and the controller may set one or more operating parameters based on the identity of all or some part of the identifiable articles present on the drying rack 47.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for operating a clothes dryer having a rotating drum defining a drying chamber, the method comprising:

imaging at least a portion of the drying chamber with an imaging device outputting image data representative of the drying chamber;

determining a presence of a stationary drying rack in the drying chamber by processing the image data with computer software stored in a controller; and controlling the operation of the clothes dryer based on the presence of the drying rack.

2. The method of claim 1 wherein the imaging comprises taking at least one of a still image or a moving image.

3. The method of claim 2 wherein the imaging comprises taking multiple still images.

4. The method of claim 1 wherein the imaging comprises taking at least one of a visible light image, an ultraviolet light image or an infrared image.

5. The method of claim 1 wherein the controlling the operation of the clothes dryer comprises determining a cycle of operation.

6. The method of claim 5 wherein the determining the cycle of operation comprises selecting a cycle of operation specific to drying on a stationary drying rack.

7. The method of claim 1 wherein the controlling the operation of the clothes dryer comprises determining an operating characteristic of the dryer based on the presence of the drying rack.

8. The method of claim 7 wherein the determining the operating characteristic comprises not rotating the drum.

9. The method of claim 7, further comprising identifying an article on the drying rack based on the imaging and determining an operating characteristic specific to the identified article.

10. The method of claim 1 wherein the controlling the operation of the clothes dryer comprises determining at least one of:

a drying temperature;

an actuation of a heating element that heats air supplied to the drying chamber;

a rate of air supplied to the drying chamber;

a rotation of the drum;

a rotational speed of the drum;

a direction of rotation of the drum;

a type of chemistry to dispense; or an amount of chemistry to dispense.

11. The method of claim 1, further comprising identifying an article on the drying rack based on the imaging.

12. The method of claim 11 wherein the identifying is a category identification of the article.

13. The method of claim 12 wherein the identifying is an identification of at least one physical characteristic of the article.

14. The method of claim 1 wherein the determining the presence of the stationary drying rack comprises detecting a physical characteristic of the drying rack from the imaging.

15. The method of claim 14 wherein the detecting a physical characteristic of the drying rack comprises detecting an edge of the drying rack.

16. A method for operating a clothes dryer having a rotating drum defining a drying chamber and a stationary drying rack located within the drying chamber, the method comprising:

imaging at least a portion of the drying chamber with an imaging device outputting image data representative of the drying chamber;

determining a presence of an article on the stationary drying rack by processing the image data with computer software stored in a controller; and controlling the operation of the clothes dryer based on the presence of the article on the drying rack.

17. The method of claim 16 wherein the imaging comprises taking at least one of a still image or a moving image.

18. The method of claim 16 wherein the imaging comprises taking at least one of a visible light image, an ultraviolet light image or an infrared image.

19. The method of claim 16 wherein the controlling the operation of the clothes dryer comprises determining an operating characteristic based on the presence of the drying rack.

20. The method of claim 19 further comprising identifying the article on the drying rack based on the imaging and determining an operating characteristic specific to the identified article.

21. The method of claim 16 wherein the controlling the operation of the clothes dryer comprises setting at least one of:

a drying temperature;
an actuation of a heating element that heats air supplied to the drying chamber;
a rate of air supplied to the drying chamber;
a rotation of the drum;
a rotational speed of the drum;
a direction of rotation of the drum;
a type of chemistry to dispense; or
an amount of chemistry to dispense.

22. The method of claim 16, further comprising identifying an article on the drying rack based on the imaging.

23. The method of claim 22 wherein the identifying is a category identification of the article.

24. The method of claim 23 wherein the identifying is an identification of at least one physical characteristic of the article.

25. The method of claim 16 wherein the determining the presence of the stationary drying rack comprises detecting a physical characteristic of the drying rack from the imaging.

26. The method of claim 25 wherein the detecting a physical characteristic of the drying rack comprises detecting an edge of the drying rack.

27. A method for operating a clothes dryer having a rotating drum defining a drying chamber and a stationary drying rack located within the drying chamber, with an article on the stationary rack, the method comprising:

imaging at least a portion of the drying chamber with an imaging device outputting image data representative of the drying chamber;
identifying an article on the stationary drying rack by processing the image data with computer software stored in a controller; and
controlling the operation of the clothes dryer based on the identification of the article on the drying rack.

28. The method of claim 27 wherein the imaging comprises taking at least one of a still image or a moving image.

29. The method of claim 27 wherein the imaging comprises taking at least one of a visible light image, an ultraviolet light image or an infrared image.

30. The method of claim 27 wherein the controlling the operation of the clothes dryer comprises determining an operating characteristic based on the identified article.

31. The method of claim 27 wherein the controlling the operation of the clothes dryer comprises setting at least one of:

a drying temperature;
an actuation of a heating element that heats air supplied to the drying chamber;
a rate of air supplied to the drying chamber;
a rotation of the drum;
a rotational speed of the drum;
a direction of rotation of the drum;
a type of chemistry to dispense; or
an amount of chemistry to dispense.

32. The method of claim 27, further comprising identifying an article on the drying rack based on the imaging.

33. The method of claim 32 wherein the identifying is a category identification of the article.

34. The method of claim 33 wherein the identifying is an identification of at least one physical characteristic of the article.

35. An automatic clothes dryer for drying laundry according to a drying cycle of operation, comprising:

a rotatable drum defining a drying chamber;
an air supply system fluidly coupled to the drying chamber configured to supply air to and exhaust air from the drying chamber;
a heating system configured to heat the air supplied by the air supply system;
a dispensing system configured to dispense an amount and type of chemistry;
an image device configured to output imaging data representative of the drying chamber; and
a controller operably coupled to the air supply system, heating system, dispensing system and imaging device and configured to determine a presence of a stationary drying rack in the drying chamber by processing the image data with computer software stored in the controller and configured to control an operation of the dryer based on the presence of the stationary drying rack.

36. The automatic clothes dryer of claim 35 wherein the controller is configured to control at least one of:

the air supply system to control an amount of air supplied to the drying chamber;
the heating system to control a temperature of the air supplied to the drying chamber;
a rotation of the drum to control at least one of a duration, direction and speed of the drum; or
a dispensing system to control at least one of a type and amount of chemistry to dispense.

37. The automatic clothes dryer of claim 35 wherein the controller is further configured to determine an operating characteristic based on the presence of the stationary drying rack.

38. The automatic clothes dryer of claim 35 further comprising at least one of the following sensors operably coupled to the controller and providing a corresponding input to the controller: a treating chamber temperature sensor, an inlet air temperature sensor, an exhaust air temperature sensor, a moisture sensor, an air flow rate sensor, a weight sensor, or a motor torque sensor.

39. The automatic clothes dryer of claim 35 wherein the imaging device captures at least one of a visible light image, an ultraviolet light image or an infrared image.

* * * * *